US009163620B2

(12) United States Patent
Ganster et al.

(10) Patent No.: US 9,163,620 B2
(45) Date of Patent: Oct. 20, 2015

(54) OIL MANAGEMENT SYSTEM FOR A COMPRESSOR

(75) Inventors: Pete Edward Ganster, Plymouth, MI (US); Kanwal Bhatia, Canton, MI (US); Michael Gregory Theodore, Jr., Plymouth, MI (US); Rodney James Callahan, Novi, MI (US); Brian Robert Kelm, Plymouth, MI (US)

(73) Assignee: Halla Visteon Climate Control Corporation, Daejeon-si (KR)

( * ) Notice: Subject to any disclaimer, the term of this patent is extended or adjusted under 35 U.S.C. 154(b) by 310 days.

(21) Appl. No.: 13/021,238

(22) Filed: Feb. 4, 2011

(65) Prior Publication Data

US 2012/0201697 A1 Aug. 9, 2012

(51) Int. Cl.

*F04B 39/02* (2006.01)
*F04B 27/10* (2006.01)
*F04B 27/18* (2006.01)

(52) U.S. Cl.

CPC ..... *F04B 27/1036* (2013.01); *F04B 27/109* (2013.01); *F04B 27/1045* (2013.01); *F04B 27/18* (2013.01); *F04B 39/02* (2013.01)

(58) Field of Classification Search

CPC ..... F04B 2027/1831; F04B 2027/1895; F04B 27/18; F04B 27/1036; F04B 27/1045; F04B 27/1054; F04B 27/109
USPC ..... 417/212, 218, 222.2, 271; 91/137, 251, 91/472, 473, 499, 504, 505
See application file for complete search history.

(56) References Cited

U.S. PATENT DOCUMENTS

| | | | | | |
|---|---|---|---|---|---|
| 3,415,160 | A | * | 12/1968 | Stein et al. | 91/6 |
| 4,061,443 | A | * | 12/1977 | Black et al. | 417/222.1 |
| 4,273,518 | A | | 6/1981 | Shibuya | |
| 4,685,866 | A | | 8/1987 | Takenaka et al. | |
| 5,044,892 | A | | 9/1991 | Pettitt | |
| 5,178,521 | A | | 1/1993 | Ikeda et al. | |
| 5,231,914 | A | * | 8/1993 | Hayase et al. | 92/12.2 |
| 5,342,178 | A | | 8/1994 | Kimura et al. | |
| 5,417,552 | A | | 5/1995 | Kayukawa et al. | |
| 5,584,670 | A | * | 12/1996 | Kawaguchi et al. | 417/222.2 |
| 5,616,008 | A | | 4/1997 | Yokono et al. | |
| 6,126,406 | A | * | 10/2000 | Kawaguchi et al. | 417/222.2 |
| 6,146,107 | A | | 11/2000 | Kawaguchi et al. | |
| 6,164,926 | A | | 12/2000 | Kawaguchi | |
| 6,206,648 | B1 | | 3/2001 | Kimura et al. | |

(Continued)

FOREIGN PATENT DOCUMENTS

| | | |
|---|---|---|
| EP | 0 965 804 A2 | 12/1999 |
| EP | 1 207 301 A2 | 5/2002 |

(Continued)

*Primary Examiner* — Bryan Lettman
*Assistant Examiner* — Charles W Nichols
(74) *Attorney, Agent, or Firm* — Fraser Clemens Martin & Miller LLC; James D. Miller

(57) ABSTRACT

A compressor including a hollow housing having a suction chamber, a discharge chamber, and a crank chamber formed therein. A first fluid flow path provided within the compressor facilitates a flow of the working fluid from the crank chamber to the suction chamber. A second fluid flow path provided within the compressor facilitates a flow of a mixture of the working fluid and a lubricating fluid from the crank chamber to the suction chamber, wherein the second fluid flow path is selectively opened and closed by an annular sleeve.

21 Claims, 4 Drawing Sheets

(56) References Cited

U.S. PATENT DOCUMENTS

| | | | | |
|---|---|---|---|---|
| 6,402,480 | B1 | 6/2002 | Sud et al. | |
| 6,942,465 | B2 | 9/2005 | Kawachi et al. | |
| 7,179,063 | B2 | 2/2007 | Casar et al. | |
| 7,520,210 | B2 | 4/2009 | Theodore, Jr. et al. | |
| 7,530,797 | B2 * | 5/2009 | Ito et al. | 417/222.2 |
| 7,811,066 | B2 | 10/2010 | Ishikawa et al. | |
| 2003/0210989 | A1 | 11/2003 | Matsuoka et al. | |
| 2004/0005223 | A1 * | 1/2004 | Kawachi et al. | 417/222.1 |
| 2004/0134342 | A1 * | 7/2004 | Casar et al. | 91/499 |
| 2005/0053480 | A1 | 3/2005 | Murakami et al. | |
| 2006/0245939 | A1 | 11/2006 | Fukanuma et al. | |
| 2008/0298980 | A1 | 12/2008 | Lim et al. | |

FOREIGN PATENT DOCUMENTS

| | | | |
|---|---|---|---|
| EP | 2 088 318 | A1 | 1/2009 |
| EP | 2 088 319 | A1 | 1/2009 |
| EP | 2 093 423 | A1 | 8/2009 |

* cited by examiner

OIL MANAGEMENT SYSTEM FOR A COMPRESSOR

FIELD OF THE INVENTION

The present invention relates to a compressor. More particularly, the invention is directed to an oil management system for a compressor.

BACKGROUND OF THE INVENTION

Presently known compressors used in refrigeration and air conditioning systems such as variable displacement swash plate compressors, for example, typically include a lubricating mist suspended in a gaseous refrigerant medium. Such compressors also include a first path that provides refrigerant communication between a crank chamber and a discharge chamber, and a second path that provides refrigerant communication between the crank chamber and a suction chamber. During operation of the compressor, the oil mist lubricates moving parts of the compressor. However, oil that remains suspended in the refrigerant as it travels throughout the refrigeration and air conditioning system can minimize a performance and an efficiency the refrigeration and air conditioning system.

To combat these problems, an oil separator is added to the refrigeration and air conditioning system. One type of oil separator is typically positioned in the refrigeration and air conditioning system between the compressor and a condenser. The oil separator functions to separate the suspended oil from the gaseous refrigerant, so that the oil is maintained in the compressor and introduced into the suction chamber. This type of oil separator requires added package space in the discharge chamber or a separate external component attached to the compressor.

A second type of oil separator utilizes the crank chamber to store the oil, so that the oil is maintained in the compressor and not introduced into the suction chamber. However, the addition of this type of oil management system in the refrigeration and air conditioning system does not address other operating conditions of the compressor which may lead to performance and durability issues such as liquid-fill start-up, high-temperature operation, or inadequate piston lubrication at high speeds caused by oil logging in the crank chamber of the compressor, for example.

It would be desirable to produce a variable displacement compressor wherein a performance, an efficiency, and a durability of the compressor are maximized, and a cost of manufacture, a weight, a package size, and an assembly time thereof are minimized.

SUMMARY OF THE INVENTION

In concordance and agreement with the present invention, a variable displacement compressor wherein a performance, an efficiency, and a durability of the compressor are maximized, and a cost of manufacture, a weight, a package size, and an assembly time thereof are minimized, has surprisingly been discovered.

In one embodiment, the compressor comprises: a hollow housing including a cylinder head having a suction chamber and a fluid passageway formed therein, a cylinder block having at least one cylinder bore formed therein, and a crankcase, wherein a substantially fluid-tight crank chamber is formed between the cylinder head and the crankcase; a rotatable driveshaft disposed in and arranged to extend through the crankcase to the cylinder block, the driveshaft including at least one fluid passageway formed therein; a first fluid flow path fluidly connecting the crank chamber to the suction chamber to facilitate a flow of a working fluid from the crank chamber to the suction chamber, the first fluid flow path including the at least one fluid passageway formed in the driveshaft; a second fluid flow path fluidly connecting the crank chamber to the suction chamber to facilitate a flow of a mixture of the working fluid and a lubricating fluid from the crank chamber to the suction chamber, the second fluid flow path including the fluid passageway formed in the cylinder head; and an annular sleeve slideably disposed between the driveshaft and the cylinder block, the annular sleeve selectively positionable to open and close the second fluid flow path.

In another embodiment, the compressor comprises: a hollow housing including a cylinder head having a suction chamber and a fluid passageway formed therein, a cylinder block having at least one cylinder bore formed therein, and a crankcase, wherein a substantially fluid-tight crank chamber is formed between the cylinder head and the crankcase; a rotatable driveshaft disposed in and arranged to extend through the crankcase to the cylinder block, the driveshaft including at least one fluid passageway formed therein; a rotor fixedly coupled to the driveshaft, wherein a rotational movement of the driveshaft causes a rotational movement of the rotor; a drive plate assembly coupled to the rotor, the drive plate assembly having an angle of inclination in respect of a plane perpendicular to a longitudinal axis of the driveshaft; a first fluid flow path fluidly connecting the crank chamber to the suction chamber to facilitate a flow of the working fluid from the crank chamber to the suction chamber, the first fluid flow path including the at least one fluid passageway formed in the driveshaft; a second fluid flow path fluidly connecting the crank chamber to the suction chamber to facilitate a flow of a mixture of the working fluid and a lubricating fluid from the crank chamber to the suction chamber, the second fluid flow path including the fluid passageway formed in the cylinder head; and an annular sleeve slideably disposed between the driveshaft and the cylinder block, the annular sleeve selectively positionable to open and close the second fluid flow path, wherein the annular sleeve is operatively coupled to the drive plate assembly to slide from a first position of the annular sleeve to a second position of the annular sleeve in response to a decrease in the angle of inclination of the drive plate assembly from a maximum to a minimum, and to slide from the second position of the annular sleeve to the first position of the annular sleeve in response to an increase in the angle of inclination of the drive plate assembly from the minimum to the maximum.

In another embodiment, the compressor comprises: a hollow housing including a cylinder head having a suction chamber and a fluid passageway formed therein, a cylinder block having at least one cylinder bore formed therein, and a crankcase, wherein a substantially fluid-tight crank chamber is formed between the cylinder head and the crankcase; a rotatable driveshaft disposed in and arranged to extend through the crankcase to the cylinder block, the driveshaft including at least one fluid passageway formed therein; a rotor fixedly coupled to the driveshaft, wherein a rotational movement of the driveshaft causes a rotational movement of the rotor; a drive plate assembly coupled to the rotor, the drive plate assembly having an angle of inclination in respect of a plane perpendicular to a longitudinal axis of the driveshaft; a first fluid flow path fluidly connecting the crank chamber to the suction chamber to facilitate a flow of the working fluid from the crank chamber to the suction chamber, the first fluid flow path including the at least one fluid passageway formed in the driveshaft; a second fluid flow path fluidly connecting the crank chamber to the suction chamber to facilitate a flow of a mixture of the working fluid and a lubricating fluid from the crank chamber to the suction chamber, the second fluid flow path including the fluid passageway formed in the cylinder head; an annular sleeve slideably disposed between the driveshaft and the cylinder block, the annular sleeve selectively positionable to open and close the second fluid flow path, wherein the annular sleeve is operatively coupled to the drive plate assembly to slide from a first position of the annular sleeve to a second position of the annular sleeve in response to a decrease in the angle of inclination of the drive plate assembly from a maximum to a minimum, and to slide from the second position of the annular sleeve to the first position of the annular sleeve in response to an increase in the angle of inclination of the drive plate assembly from the minimum to the maximum, wherein the second fluid flow path is closed when the annular sleeve is in the first position and open when the annular sleeve is in the second position; a constant flow feature fluidly connecting the crank chamber to the suction chamber to facilitate a constant flow of the mixture of the working fluid and the lubricating fluid from the crank chamber to the suction chamber; and a bearing lubrication feature to facilitate a flow of the mixture of the working fluid and the lubricating fluid around at least one bearing disposed in the cylinder block.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF THE INVENTION

The following detailed description and appended drawings describe and illustrate an exemplary embodiment of the invention. The description and drawings serve to enable one skilled in the art to make and use the invention, and are not intended to limit the scope of the invention in any manner.

Figure 1:
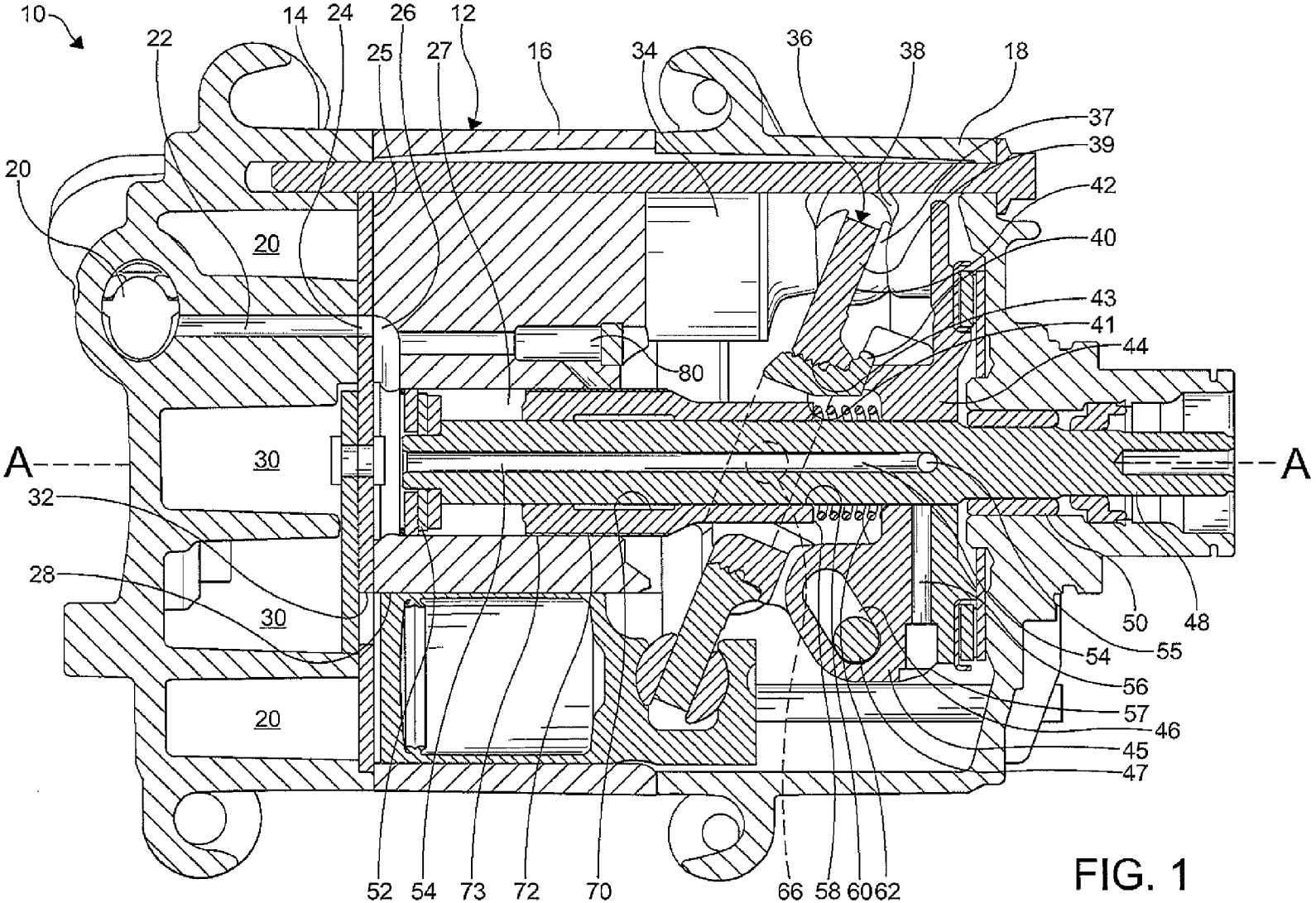
FIG. 1 is a cross-sectional elevational view of a compressor including an oil management system according to an embodiment of the present invention showing an annular sleeve of the oil management system in a first position.

FIG. 1 shows a variable displacement swash plate type compressor 10 according to the present invention. The compressor 10 includes a cylindrical housing 12 having a cylinder head 14, a cylinder block 16, and a crankcase 18. The cylinder head 14 includes a suction chamber 20 formed therein. An inlet port (not shown) and associated inlet conduit (not shown) provide fluid communication between the suction chamber 20 and an external component (not shown) such as an evaporator of a heating, ventilating, and air conditioning system, for example. A fluid passageway 22 is formed in the cylinder head 14. The fluid passageway 22, through an opening 24 formed in a valve plate 25 and a cavity 26 formed in the cylinder block 16, is in fluid communication with a central bore 27 formed in the cylinder block 16. The fluid passageway 22, the opening 24, and the cavity 26 fluidly connect the central bore 27 to the suction chamber 20 to facilitate a flow of a working fluid (e.g. a refrigerant) from the central bore 27 to the suction chamber 20.

The suction chamber 20 is also in fluid communication with a plurality of cylinder bores 28 formed in the cylinder block 16 through a plurality of valved suction ports (not shown) formed in the valve plate 25. Each of the cylinder bores 28 is formed in the cylinder block 16 at a predetermined interval and circumscribing arranged around a longitudinal axis A of the compressor 10. Each of the cylinder bores 28 is also in fluid communication with a discharge chamber 30 through a plurality of valved discharge ports 32 formed in the valve plate. An outlet port (not shown) and associated outlet conduit (not shown) provide fluid communication between the discharge chamber 30 and an external component (not shown) such as a condenser of a heating, ventilating, and air conditioning system, for example. A piston 34 is slideably received in each of the cylinder bores 28.

As shown, the pistons 34 are coupled to a drive plate assembly 36 via shoes 37. It is understood that the drive plate assembly 36 can be any drive plate assembly desired such as a swash plate or a wobble plate, for example. As illustrated, the drive plate assembly 36 has a generally disc shape and is disposed in a fluid-tight crank chamber 38 formed by the cylinder block 16 and the crankcase 18. The drive plate assembly 36 includes an annular plate 39 and a hub member 40 having a central aperture 41 formed therein. It is understood that the annular plate 39 and the hub member 40 can be formed separately or as an integral structure if desired. The annular plate 39 includes a pair of opposed, substantially planar surfaces 42 and a central aperture 43 formed therein. At least a portion of the hub member 40 is received in the central aperture 43 of the annular plate 39 and mechanically coupled thereto to form the drive plate assembly 36.

The drive plate assembly 36 is mechanically coupled to a rotor 44. The rotor 44 is configured to vary an angle of inclination of the drive plate assembly 36 in respect of a plane perpendicular to the longitudinal axis A of the compressor 10. The rotor 44 includes an outwardly extending arm portion 45 having an opening 46 formed therein. As shown, a guide pin 47 formed on the drive plate assembly 36 slideably engages walls forming the opening 46 formed in the arm portion 45 of the rotor 44. The rotor 44 is fixedly coupled to a rotatable driveshaft 48.

The driveshaft 48 is centrally disposed in and arranged to extend through the crankcase 18 to the cylinder block 16 of the compressor 10. The driveshaft 48 shown is rotatably supported by a roller bearing 50 at a first end thereof and thrust bearings 52 at a second end thereof. The drive shaft 48 is mechanically coupled to a power source (e.g. an engine) via a pulley (not shown) which causes the driveshaft 48 to rotate. An axially extending fluid passageway 54 and a radially outwardly extending fluid passageway 55 are formed in the driveshaft 48. It is understood that additional radially outwardly extending passageways (not shown) can be formed in the driveshaft 48 and connected to the axially extending passageway 54 as desired. The passageways 54, 55 of the driveshaft 48 are in fluid communication with a fluid passageway 56 formed in the rotor 44. It is understood that additional fluid passageways (not shown) can be formed in the rotor 44 as desired. The fluid passageway 56 extends from a centrally formed aperture (not shown) formed in the rotor 44 to a radial outer surface 57 thereof. The fluid passageways 54, 55, 56 cooperate to provide a flow path between the crank chamber 38 and the central bore 27 formed in the cylinder block 16. Accordingly, a first fluid flow path between the crank chamber 38 and the suction chamber 20 is provided by the fluid passageways 22, 54, 55, 56, the opening 24 of the valve plate 25, and the cavity 26 of the cylinder block 16 to facilitate a flow of the working fluid from the crank chamber 38 to the suction chamber 20.

Figure 2:
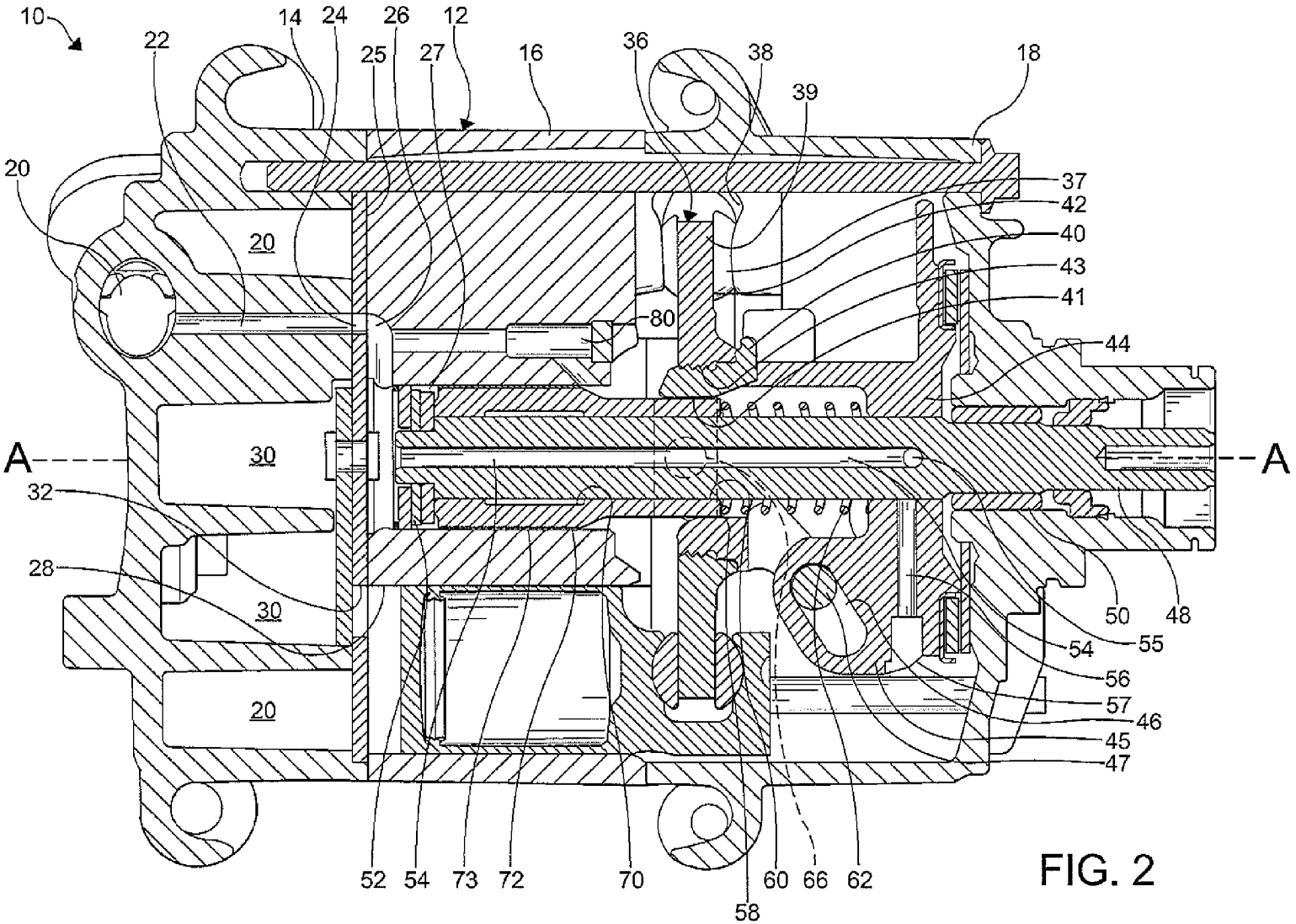
FIG. 2 is a cross-sectional elevational view of the compressor illustrated in FIG. 1 showing the annular sleeve of the oil management system in a second position.
Figure 3:
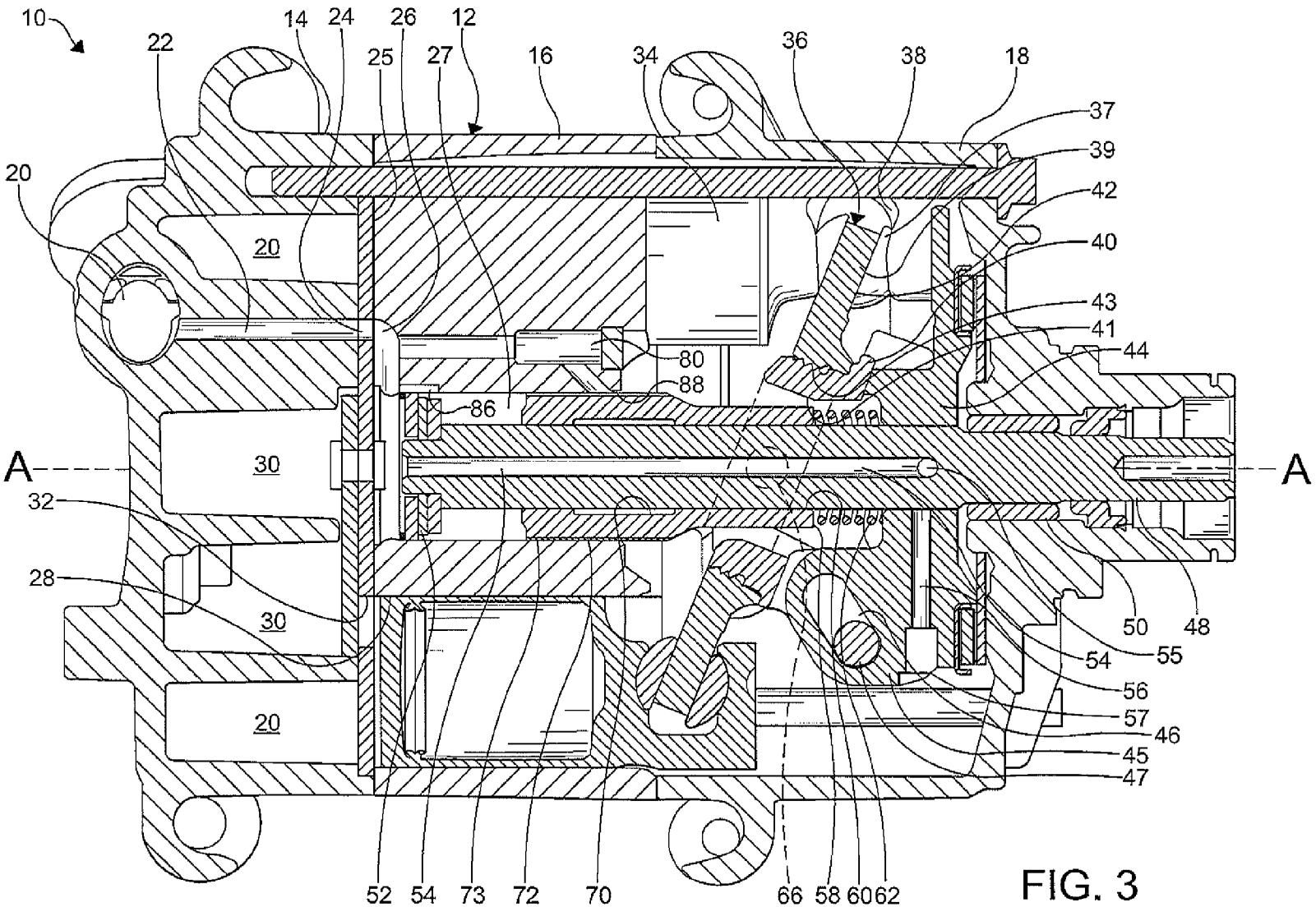
FIG. 3 is a cross-sectional elevational view of the compressor illustrated in FIG. 1 including a constant flow feature and a bearing lubrication feature of the oil management system.
Figure 4:
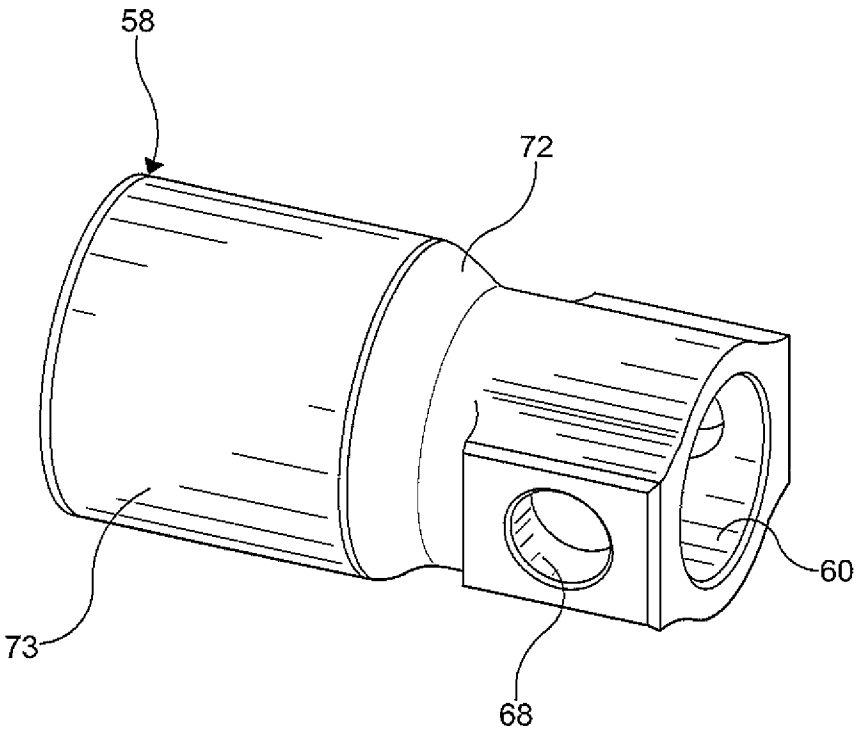
FIG. 4 is an enlarged side perspective view of the annular sleeve of the oil management system shown in FIGS. 1-3.

A rotatable annular sleeve 58 having a bore 60 formed therein surrounds and provides support to the driveshaft 48 along a longitudinal axis thereof. It is understood that the annular sleeve 58 can have any shape and size as desired such as having a bore diameter of about 26 mm, for example. The annular sleeve 58 is coupled to the hub member 40 of the drive plate assembly 36. Particularly, the annular sleeve 58 shown is pivotally coupled to the drive plate assembly 36 by a plurality of pins 66 indicated by dashed lines in FIGS. 1-3. The pins 66 are received in respective apertures 68, shown in FIG. 4, formed opposite in the first end of the annular sleeve 58 and aligned apertures (not shown) formed in the hub member 40 of the drive plate assembly 36. A spring 62 is disposed around an outer surface of the driveshaft 48 between a first end of the annular sleeve 58 the rotor 44. An annular recess 70 is formed in the annular sleeve 58 for receiving a lubricant such as a lubricating fluid (e.g. an oil) disposed in the crank chamber 38 of the compressor 10, for example, therein to provide lubrication and minimize friction between the annular sleeve 58 and the driveshaft 48. In a non-limiting example, the lubricating fluid disposed in the crank chamber 38 flows along an outer surface of the driveshaft 48 between the annular sleeve 58 and the driveshaft 48 and is received in the annular recess 70. An outer surface 72 of the annular sleeve 58 includes a surface treatment such as a coating 73 as shown in FIGS. 1-3, a mechanical treatment, or a chemical treatment, for example, to minimize friction between the annular sleeve 58 and the cylinder block 16. In a non-limiting example, the coating 73 is a layer of material such as Teflon®, for example. It is understood, however, that any suitable material can be used for the coating 73 as desired.

The annular sleeve 58 is axially slideable along the driveshaft 48 to be reciprocally received in the central bore 27 of the cylinder block 16. A position of the annular sleeve 58 along the driveshaft 48 corresponds to the angle of inclination of the drive plate assembly 36. In particular, when the angle of inclination of the drive plate assembly 36 is maximized as shown in FIG. 1, the annular sleeve 58 is in a first position. Conversely, when the angle of inclination of the drive plate assembly 36 is minimized as shown in FIG. 2, the annular sleeve 58 is in a second position. A second end of the annular sleeve 58 abuts one of the thrust bearings 52 when the annular sleeve 58 is in the second position. When the angle of inclination of the drive plate assembly 36 is between the maximum and the minimum, the annular sleeve 58 is in an intermediate position between the first position and the second position.

A fluid passageway 80 formed in the cylinder block 16 is provided as a bypass to facilitate a flow of a mixture of the working fluid and the lubricating fluid between the crank chamber 38 and the suction chamber 20. Accordingly, a second fluid flow path between the crank chamber 38 and the suction chamber 20 is provided by the fluid passageways 22, 80, the opening 24 of the valve plate 25, and the cavity 26 of the cylinder block 16 to facilitate a flow of the working fluid from the crank chamber 38 to the suction chamber 20. The fluid passageway 80, and thereby the second fluid flow path, is selectively opened and closed by the annular sleeve 58 axially sliding along the driveshaft 48. In particular, when the annular sleeve 58 in the first position shown in FIG. 1, an inlet of the passageway 80 is fully closed. Conversely, when the annular sleeve 58 is in the second position shown in FIG. 2, the inlet of the passageway 80 is fully open. When the annular sleeve 58 is in the intermediate position, the inlet of the passageway 80 is fully open, fully closed, or at least partially open.

A constant flow feature 88 shown in FIG. 3 may be employed in the compressor 10 to facilitate a constant flow of the mixture of the working fluid and the lubricating fluid from the crank chamber 38 to the suction chamber 20. In the embodiment shown, the constant flow feature 88 is a recess formed in the cylinder block 16 forming a gap between the annular sleeve 58 and the cylinder block 16. It is understood that the constant flow feature 88 can be a recess formed in the annular sleeve 58 forming the gap between the annular sleeve 58 and the cylinder block 16 if desired. The gap facilitates a constant flow of the mixture of the working fluid and the lubricating fluid from the crank chamber 38 into the fluid passageway 80 and to the suction chamber 20. It is understood that the recess can be formed in the cylinder block 16 or the annular sleeve 58 by any means as desired such as cast in the cylinder block 16 or annular sleeve 58 and machined in the cylinder block 16 or annular sleeve 58 after a casting thereof, for example. A bearing lubrication feature 86 shown in FIG. 3 may be employed in the compressor 10 to facilitate a flow of the mixture of the working fluid and the lubricating fluid around the thrust bearings 52 for a lubrication thereof. In the embodiment shown, the bearing lubrication feature 86 is a recess formed in the cylinder block 16. It is understood that the recess can be formed by any means as desired such as cast in the cylinder block 16 or machined in the cylinder block 16 after a casting thereof, for example.

During operation of the compressor 10, the driveshaft 48 is caused to rotate by the external power source. Rotation of the driveshaft 48 causes the rotor 44 to correspondingly rotate with the driveshaft 48. As the rotor 44 rotates, the connection between the drive plate assembly 36 and rotor 44 causes the drive plate assembly 36 to rotate. The rotation of the drive plate assembly 36 causes the pistons 34 to reciprocate within the cylinder bores 28. As the pistons 34 are caused to move toward a bottom dead center position, the pressure within the cylinder bores 28 is less than a pressure within the suction chamber 20. Accordingly, the valved suction ports are caused to open causing the working fluid to flow from the suction chamber 20 through the valved suction ports and into the cylinder bores 28. As the pistons 34 are caused to move toward a top dead center position, the working fluid within the cylinder bores 28 is compressed. When the pressure within the cylinder bores 28 is caused to exceed the pressure within the discharge chamber 30, the valved discharge ports 32 are caused to open and the compressed working fluid is caused to flow through the valve discharge ports 32 into the discharge chamber 30.

Further, as the pistons 34 are caused to move toward the top dead center position, the pressure within the cylinder bores 28 is caused to exceed a pressure within the crank chamber 38. As the pistons 34 are caused to move toward the bottom dead center position, the pressure within the cylinder bores 28 is less than the pressure within the crank chamber 38. Accordingly, as the pistons 34 reciprocate, the pressure within the discharge chamber 30 is greater than the pressure within the crank chamber 38, which is greater than the pressure within the suction chamber 20. These pressure differences between the discharge chamber 30, the crank chamber 38, and the suction chamber 20 cause the working fluid and the lubricating fluid to flow into the crank chamber 30 and mix.

The pressure difference between the crank chamber 38 and the suction chamber 20 causes the mixture to flow into the passageway 56 formed in the rotor 44. The rotation of the rotor 44 generates a centrifugal force that is exerted upon the mixture. A density of the lubricating fluid is higher than a density of the working fluid. The differences in material properties between the working fluid and the lubricating fluid, and the centrifugal force exerted on the mixture, cause a separation of the lubricating fluid from the working fluid. Since the lubricating fluid has a higher density than the working fluid, the lubricating fluid is caused to flow back into the crank chamber 39. Simultaneously, the working fluid continues to flow through the first fluid flow path into the suction chamber 20.

When the operation of the compressor 10 is initiated by the rotation of the driveshaft 48, the pressure within the suction chamber 20 is temporarily and rapidly dropped. Accordingly, the pressure within the crank chamber 38 is greater than the pressure within the suction chamber 20 causing the angle of inclination of the drive plate assembly 36 and the length of the stroke of the pistons 34 to be minimized. When the angle of inclination of the drive plate assembly 36 is minimized, the annular sleeve 58 is positioned at the second position as shown in FIG. 2 fully opening the inlet of the fluid passageway 80. Accordingly, a maximum amount of the mixture of the working fluid and the lubricating fluid flows from the crank chamber 38, into and through the second fluid flow path, and into the suction chamber 20. Therefore, as the pistons 34 are caused to move toward the bottom dead center position, the mixture of the working fluid and the lubricating fluid is received into the cylinder bores 28. The mixture of the working fluid and the lubricating fluid lubricates the pistons 34, as well as facilitates a sealing effect between the pistons 34 and the cylinder bores 28. The sealing effect restricts a flow of the mixture from the cylinder bores 28 into the crank chamber 38.

As the operation of the compressor 10 continues and the mixture of the working fluid and lubricating fluid flows from the crank chamber 38 to the suction chamber 20, the pressure difference between the pressure within the crank chamber 38 and the pressure within the suction chamber 20 is gradually decreased. As a result, the angle of inclination of the drive plate assembly 36 and the length of the stroke of the pistons 34 are gradually increased. As the angle of inclination of the drive plate assembly 36 increases from the minimum to the maximum (i.e. full displacement operation of the compressor 10), the annular sleeve 58 is caused to move from the second position, to the intermediate position, and then to the first position shown in FIG. 1. Accordingly, the annular sleeve 58 slides from the second position fully opening the inlet of the fluid passageway 80, to the intermediate position, and then to the first position fully closing the inlet of the fluid passageway 80 and militating against the flow of the mixture of the working fluid and the lubricating fluid from the crank chamber 38, into and through the second fluid flow path to the suction chamber 20.

During the increase in the angle of inclination of the drive plate assembly 36 from the minimum to the maximum, a first predetermined angle of inclination of the drive plate assembly 36 and a second predetermined angle of inclination of the drive plate assembly 36 are reached. At the first predetermined angle of inclination of the drive plate assembly 36, the annular sleeve 36 is caused to move from fully opening the inlet of the fluid passageway 80 to partially opening the inlet of the fluid passageway 80 Accordingly, a reduced amount of the mixture of the working fluid and the lubricating fluid flows from the crank chamber 38, into and through the second fluid flow path, and into the suction chamber 20. At the second predetermined angle of inclination of the drive plate assembly 36, the annular sleeve 36 is caused to move from partially opening the inlet of the fluid passageway 80 to fully closing the inlet of the fluid passageway 80 and militating against the flow of the mixture of the working fluid and the lubricating fluid flows from the crank chamber 38, into and through the second fluid flow path, and into the suction chamber 20.

After the compressor 10 has operated at full displacement for an appropriate period of time, a load applied to the compressor 10 is reduced. The reduction in the load applied to the compressor 10 causes the pressure within the suction chamber 20 to decrease. The decrease in the pressure within the suction chamber 20 causes the pressure differential between the pressure within the crank chamber 38 and the pressure within the suction chamber 20 to increase. As a result, the angle of inclination of the drive plate assembly 36 and the length of the stroke of the pistons 34 are caused to decrease from the maximum to the minimum (i.e. small displacement operation of the compressor 10). As described hereinabove, when the angle of inclination of the drive plate assembly 36 is minimized, the annular sleeve 58 is positioned at the second position as shown in FIG. 2 fully opening the inlet of the fluid passageway 80. Accordingly, the maximum amount of the mixture of the working fluid and the lubricating fluid flows from the crank chamber 38, into and through the second fluid flow path, and into the suction chamber 20.

During the decrease in the angle of inclination of the drive plate assembly 36 from the maximum to the minimum, the second predetermined angle of inclination of the drive plate assembly 36 and the first predetermined angle of inclination of the drive plate assembly 36 are reached. At the second predetermined angle of inclination of the drive plate assembly 36, the annular sleeve 36 is caused to move from fully closing the inlet of the fluid passageway 80 to partially opening the inlet of the fluid passageway 80. Accordingly, an increased amount of the mixture of the working fluid and the lubricating fluid flows from the crank chamber 38, into and through the second fluid flow path, and into the suction chamber 20. At the first predetermined angle of inclination of the drive plate assembly 36, the annular sleeve 36 is caused to move from partially opening the inlet of the fluid passageway 80 to fully opening the inlet of the fluid passageway 80. Accordingly, the maximum amount of the mixture of the working fluid and the lubricating fluid flows from the crank chamber 38, into and through the second fluid flow path, and into the suction chamber 20.

When the compressor 10 is caused to operate between the full displacement operation and the small displacement operation, the angle of inclination of the drive plate assembly 36 and the length of the stroke of the pistons 34 are between the maximum and the minimum. Accordingly, the annular sleeve 58 is positioned at the intermediate position between the first position and the second position. Depending on the angle of the inclination of the drive plate assembly 36 between the maximum and the minimum, the first predetermined angle of inclination, and the second predetermined angle of inclination, the inlet of the fluid passageway 80 is fully opened, fully closed, or partially opened.

Optionally, the mixture of the working fluid and the lubricating fluid can be caused to flow from the crank chamber 38 through the constant flow feature 88 to the suction chamber 20 regardless of the angle of inclination of the drive plate assembly 36. Further, the mixture of the working fluid and the lubricating fluid can be caused to flow from the cavity 26 formed in the cylinder block 16, into and through the bearing lubrication feature 86, and around the thrust bearings 52 to provide lubrication thereto.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A compressor, comprising:

a hollow housing including a cylinder head having a suction chamber and a fluid passageway formed therein, a cylinder block having at least one cylinder bore formed therein, and a crankcase, wherein a substantially fluid-tight crank chamber is formed between the cylinder head and the crankcase;

a rotatable driveshaft disposed in and arranged to extend through the crankcase to the cylinder block, the driveshaft including at least one fluid passageway formed therein;

a drive plate assembly having an angle of inclination in respect of a plane substantially perpendicular to a longitudinal axis of the driveshaft;

a first fluid flow path fluidly connecting the crank chamber to the suction chamber to facilitate a flow of a working fluid from the crank chamber to the suction chamber, the first fluid flow path including the at least one fluid passageway formed in the driveshaft;

a second fluid flow path fluidly connecting the crank chamber to the suction chamber to facilitate a flow of a mixture of the working fluid and a lubricating fluid from the crank chamber to the suction chamber, the second fluid flow path including the fluid passageway formed in the cylinder head;

an annular sleeve slideably disposed between the driveshaft and the cylinder block, the annular sleeve selectively positionable to open and close the second fluid flow path;

at least one bearing disposed in the cylinder block between the suction chamber and the annular sleeve; and a recess formed in at least one of the cylinder block and the annular sleeve continuously fluidly connecting the crank chamber to an inlet of the second fluid flow path and forming a gap between the annular sleeve and the cylinder block, and wherein the gap facilitates a constant flow of the mixture of the working fluid and the lubricating fluid from the crank chamber to the suction chamber, wherein an inlet of the second fluid flow path is fully closed when the annular sleeve is in a first position and the angle of inclination of the drive plate assembly is maximized, and fully open when the annular sleeve is in a second position and the angle of inclination of the drive plate assembly is minimized.

2. The compressor according to claim 1, wherein the second fluid flow path is at least partially open when the annular sleeve is in an intermediate position between the first position and the second position, and the angle of inclination of the drive plate assembly is between a minimum and a maximum.

3. The compressor according to claim 1, wherein the annular sleeve is operatively coupled to the drive plate assembly to slide from the first position of the annular sleeve to a second position of the annular sleeve in response to a decrease in the angle of inclination of the drive plate assembly, and from the second position of the annular sleeve to the first position of the annular sleeve in response to an increase in the angle of inclination of the drive plate assembly.

4. The compressor according to claim 1, wherein the annular sleeve includes an annular recess formed in an inner surface thereof for receiving a lubricant therein, the lubricant providing lubrication to and minimizing friction between the annular sleeve and the driveshaft.

5. The compressor according to claim 1, wherein the annular sleeve includes a surface treatment to minimize friction between the annular sleeve and the cylinder block.

6. The compressor according to claim 1, further comprising a bearing lubrication feature to facilitate a flow of the mixture of the working fluid and the lubricating fluid around the at least one bearing disposed in the cylinder block.

7. A compressor, comprising:

a hollow housing including a cylinder head having a suction chamber and a fluid passageway formed therein, a cylinder block having at least one cylinder bore formed therein, and a crankcase, wherein a substantially fluid-tight crank chamber is formed between the cylinder head and the crankcase;

a rotatable driveshaft disposed in and arranged to extend through the crankcase to the cylinder block, the driveshaft including at least one fluid passageway formed therein;

a rotor fixedly coupled to the driveshaft, wherein a rotational movement of the driveshaft causes a rotational movement of the rotor;

a drive plate assembly coupled to the rotor, the drive plate assembly having an angle of inclination in respect of a plane perpendicular to a longitudinal axis of the driveshaft;

a first fluid flow path fluidly connecting the crank chamber to the suction chamber to facilitate a flow of the working fluid from the crank chamber to the suction chamber, the first fluid flow path including the at least one fluid passageway formed in the driveshaft;

a second fluid flow path fluidly connecting the crank chamber to the suction chamber to facilitate a flow of a mixture of the working fluid and a lubricating fluid from the crank chamber to the suction chamber, the second fluid flow path including the fluid passageway formed in the cylinder head;

an annular sleeve slideably disposed between the driveshaft and the cylinder block, the annular sleeve selectively positionable to open and close the second fluid flow path;

at least one bearing disposed in the cylinder block between the suction chamber and the annular sleeve; and a recess formed in at least one of the cylinder block and the annular sleeve continuously fluidly connecting the crank chamber to an inlet of the second fluid flow path and forming a gap between the annular sleeve and the cylinder block, and wherein the gap facilitates a constant flow of the mixture of the working fluid and the lubricating fluid from the crank chamber to the suction chamber, wherein the annular sleeve is operatively coupled to the drive plate assembly to slide from a first position of the annular sleeve to a second position of the annular sleeve in response to a decrease in the angle of inclination of the drive plate assembly from a maximum to a minimum, and to slide from the second position of the annular sleeve to the first position of the annular sleeve in response to an increase in the angle of inclination of the drive plate assembly from the minimum to the maximum, wherein an inlet of the second fluid flow path is fully closed when the annular sleeve is in the first position and fully open when the annular sleeve is in the second position.

8. The compressor according to claim 7, wherein the second fluid flow path is at least partially open when the annular sleeve is in an intermediate position between the first position and the second position and the angle of inclination of the drive plate assembly is between the minimum and the maximum.

9. The compressor according to claim 7, wherein the annular sleeve includes an annular recess formed in an inner surface thereof for receiving a lubricant therein, the lubricant providing lubrication to and minimizing friction between the annular sleeve and the driveshaft.

10. The compressor according to claim 7, wherein the annular sleeve includes a surface treatment to minimize friction between the annular sleeve and the cylinder block.

11. The compressor according to claim 7, further comprising a bearing lubrication feature to facilitate a flow of the mixture of the working fluid and the lubricating fluid around the at least one bearing disposed in the cylinder block.

12. A compressor, comprising:

a hollow housing including a cylinder head having a suction chamber and a fluid passageway formed therein, a cylinder block having at least one cylinder bore formed therein, and a crankcase, wherein a substantially fluid-tight crank chamber is formed between the cylinder head and the crankcase;

a rotatable driveshaft disposed in and arranged to extend through the crankcase to the cylinder block, the driveshaft including at least one fluid passageway formed therein;

a rotor fixedly coupled to the driveshaft, wherein a rotational movement of the driveshaft causes a rotational movement of the rotor;

a drive plate assembly coupled to the rotor, the drive plate assembly having an angle of inclination in respect of a plane perpendicular to a longitudinal axis of the driveshaft;

a first fluid flow path fluidly connecting the crank chamber to the suction chamber to facilitate a flow of the working fluid from the crank chamber to the suction chamber, the first fluid flow path including the at least one fluid passageway formed in the driveshaft;

a second fluid flow path fluidly connecting the crank chamber to the suction chamber to facilitate a flow of a mixture of the working fluid and a lubricating fluid from the crank chamber to the suction chamber, the second fluid flow path including the fluid passageway formed in the cylinder head;

an annular sleeve slideably disposed between the driveshaft and the cylinder block, the annular sleeve selectively positionable to open and close an inlet of the second fluid flow path, wherein the annular sleeve is operatively coupled to the drive plate assembly to slide from a first position of the annular sleeve to a second position of the annular sleeve in response to a decrease in the angle of inclination of the drive plate assembly from a maximum to a minimum, and to slide from the second position of the annular sleeve to the first position of the annular sleeve in response to an increase in the angle of inclination of the drive plate assembly from the minimum to the maximum, wherein the inlet of the second fluid flow path is fully closed when the annular sleeve is in the first position and fully open when the annular sleeve is in the second position;

at least one bearing disposed in the cylinder block between the suction chamber and the annular sleeve;

a recess framed in at least one of the cylinder block and the annular sleeve continuously fluidly connecting the crank chamber to an inlet of the second fluid flow path and forming a gap between the annular sleeve and the cylinder block, and wherein the gap facilitates a constant flow of the mixture of the working fluid and the lubricating fluid from the crank chamber to the suction chamber; and a bearing lubrication feature to facilitate a flow of the mixture of the working fluid and the lubricating fluid around at least one bearing disposed in the cylinder block.

13. The compressor according to claim 12, wherein the annular sleeve includes an annular recess formed in an inner surface thereof for receiving a lubricant therein, the lubricant providing lubrication to and minimizing friction between the annular sleeve and the driveshaft, and a surface treatment to minimize friction between the annular sleeve and the cylinder block.

14. The compressor according to claim 4, wherein the annular recess is formed in the inner surface of the annular sleeve intermediate a first end and a second end thereof.

15. The compressor according to claim 5, wherein the surface treatment is a coating of a layer of polytetrafluoroethylene material.

16. The compressor according to claim 9, wherein the annular recess is formed in the inner surface of the annular sleeve intermediate a first end and a second end thereof.

17. The compressor according to claim 10, wherein the surface treatment is a coating of a layer of polytetrafluoroethylene material.

18. The compressor according to claim 13, wherein the annular recess is formed in the inner surface of the annular sleeve intermediate a first end and a second end thereof.

19. The compressor according to claim 1, wherein the recess provides direct fluid communication between the crank chamber and the second fluid flow path.

20. The compressor according to claim 7, wherein the recess provides direct fluid communication between the crank chamber and the second fluid flow path.

21. The compressor according to claim 12, wherein the recess provides direct fluid communication between the crank chamber and the second fluid flow path.

* * * * *